US007626107B1

(12) United States Patent
Takegawa

(10) Patent No.: US 7,626,107 B1
(45) Date of Patent: Dec. 1, 2009

(54) CONNECTION SYSTEM BETWEEN FOOTBOARD AND HEEL PLATE OF A FOOT PEDAL SYSTEM

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 12/273,930

(22) Filed: Nov. 19, 2008

(51) Int. Cl.
*G10D 13/02* (2006.01)

(52) U.S. Cl. ..... 84/422.1; 84/422.3

(58) Field of Classification Search ..... 84/422.1, 84/422.3
See application file for complete search history.

(56) References Cited

U.S. PATENT DOCUMENTS

| | | | | |
|---|---|---|---|---|
| 2,132,211 | A | 10/1938 | Hueckstead | |
| 3,030,847 | A * | 4/1962 | Thompson | 84/422.1 |
| 4,134,325 | A * | 1/1979 | Loftus | 84/422.1 |
| 4,188,853 | A | 2/1980 | Bills | |
| 4,235,146 | A * | 11/1980 | Purdy | 84/422.1 |
| 4,691,613 | A * | 9/1987 | Jacobson | 84/422.1 |
| 4,756,224 | A | 7/1988 | Lombardi | |
| 4,819,536 | A | 4/1989 | Lombardi | |
| 4,873,910 | A | 10/1989 | Kurosaki | |
| 5,431,081 | A | 7/1995 | Lombardi | |
| 5,565,638 | A | 10/1996 | Liao | |
| 5,574,237 | A * | 11/1996 | Yanagisawa | 84/422.1 |
| 5,990,400 | A | 11/1999 | Hoshino | |
| 6,011,208 | A | 1/2000 | Hoshino | |
| 6,100,460 | A | 8/2000 | Hoshino | |
| 6,359,205 | B1 * | 3/2002 | Lombardi | 84/422.1 |
| 6,570,076 | B1 * | 5/2003 | Kjellgren | 84/422.1 |
| 6,573,443 | B1 | 6/2003 | Chen | |
| 6,590,147 | B2 | 7/2003 | Kassabian | |
| 6,683,240 | B1 | 1/2004 | Cubranich | |
| 6,689,945 | B1 * | 2/2004 | Matsuzoe et al. | 84/422.1 |
| 6,992,244 | B2 | 1/2006 | Paul et al. | |
| 7,179,978 | B2 * | 2/2007 | Takegawa | 84/422.1 |
| 7,197,957 | B2 * | 4/2007 | Gatzen | 74/560 |
| 7,262,356 | B1 * | 8/2007 | Lukios, II | 84/422.1 |
| 7,399,916 | B1 * | 7/2008 | Lombardi | 84/422.1 |
| 2002/0056357 | A1 | 5/2002 | Kassabian | |
| 2006/0272476 | A1 | 12/2006 | Packer | |
| 2007/0044637 | A1 | 3/2007 | Kjellfren | |
| 2008/0173159 | A1 * | 7/2008 | Chen | 84/422.1 |

FOREIGN PATENT DOCUMENTS

| | | |
|---|---|---|
| DE | 39 32 135 | 9/1990 |
| EP | 0 403 689 | 12/1990 |
| GB | 2 172 137 | 9/1986 |

* cited by examiner

*Primary Examiner*—Jeffrey Donels
*Assistant Examiner*—Robert W Horn
(74) *Attorney, Agent, or Firm*—Berenato & White, LLC

(57) ABSTRACT

A foot pedal apparatus for operating a musical instrument, comprising an elongated footboard including a hinge plate fixed to the rear portion of the footboard and a stationary heel plate with a front portion. A hinge assembly couples the hinge plate at the footboard rear portion to the heel plate front portion and enables the footboard to pivot relative to the heel plate, wherein the hinge plate may be fixed at different positions on the footboard to adjust a length of the footboard relative to the axle. A portion of the heel plate may be repositioned between the hinge shaft and the footboard to define the extended footboard. As a result, the torque provided by the footboard can be adjusted to adjust the feel of the pedal and to accommodate feet of different sizes. Additionally, spherical bearings on the hinge shaft improve the function of the pedal assembly by compensating for a slightly misaligned axle.

16 Claims, 10 Drawing Sheets

CONNECTION SYSTEM BETWEEN FOOTBOARD AND HEEL PLATE OF A FOOT PEDAL SYSTEM

FIELD OF THE INVENTION

The present invention relates generally to foot pedals, and more particularly to a connection system between the footboard and the heel plate of a foot pedal system for operating a drum, a cymbal, or a similar foot-operated instrument.

BACKGROUND OF THE INVENTION

A conventional foot pedal for a musical instrument rotates a beater 121 to beat a drum, as shown in FIG. 1, or to raise or lower an operating rod for a high hat cymbal 130, as shown in FIG. 2.

A conventional pedal F shown in FIG. 3 comprises a footboard 100 which operates the action part, i.e., the beater 121 or the operating rod 131, and a heel plate 110 that is connected to the rear of the footboard 100. A link 101 connects the footboard to the action part. The footboard 100 is movable while the heel plate 110 is stationary. They are connected at a pivot in a rotatable fashion at axle 105. This connection in the prior art includes a cut out concave 102 region formed at the rear of the pedal plate 100, a rotation axle 105 extending across the concave 102 and a convex part 111 extending forward from the heel plate and extending into the concave 102. A trough hole 112 is provided across the convex part 111 at the axle 105 at the front of the heel plate 110. It is aligned with the holes at the sides of the concave 102 on axle 105. Nylon bushes 115 are provided between the axle 105 and the through hole 112, making the footboard freely pivotable.

In this conventional structure, the axle 105 is fixed to the footboard 100 but rotates inside the inner hole of the nylon bush 115 that has been installed on the heel plate 110 as the footboard 100 pivots. To reduce the friction resistance with the axle 105 during rotation, a gap S1 is formed in the inner hole of the nylon bush 115. In addition, a gap S2 for reducing friction resistance is required between the nylon bush 115 that has been installed on the heel plate 110 and the concave 102 of the footboard 100.

However, either gap S1 or S2 creates looseness or play in the footboard 100 during operation of the foot pedal, possibly causing noise or beating power loss during a performance. Some performers dislike this kind of looseness or play.

Moreover, it is important that these foot pedals have good overall performance, including adequate response and reaction time. Over the years, drum pedals have been under continuous development, for improving the response of the pedals, the reaction time, and the overall feel of the drum pedal to the drummer himself, for maximizing the performance of the drummer in playing bass drums. The need thus exists to improve the frictional engagement of the moving parts of a drum pedal while permitting an adjustable foot pedal to change the feel of the pedal, to accommodate different sized feet, and to enhance or improve the performance of the drum pedal.

SUMMARY OF THE INVENTION

A foot pedal apparatus for operating a musical instrument comprises an elongated footboard including an adaptor fixed to the footboard and a changeable heel plate which may be selectively positioned to adjust the length of the footboard. A connection assembly couples the adaptor at the footboard rear portion to the hinge assembly and heel plate and enables the footboard to pivot relative to the heel plate, wherein the adaptor may be fixed at different positions on the footboard to adjust a length of the footboard relative to the axle. As a result, the leverage or torque provided by the footboard may be adjusted to adjust the feel and force of the pedal. The footboard also can accommodate feet of different sizes. It is important to note that the spherical bearing assembly of the invention improves the function of the pedal assembly by compensating for a slightly misaligned axle.

DETAILED DESCRIPTION OF PREFERRED EMBODIMENT

Figure 1:
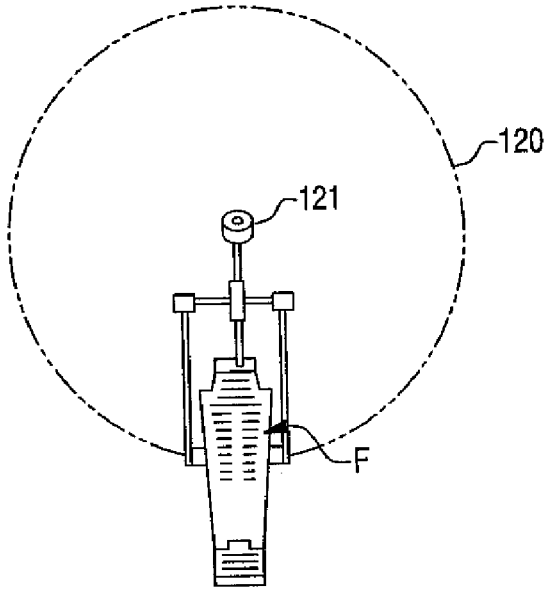
FIG. 1 is a schematic showing a conventional foot pedal as used with a bass drum.
Figure 2:
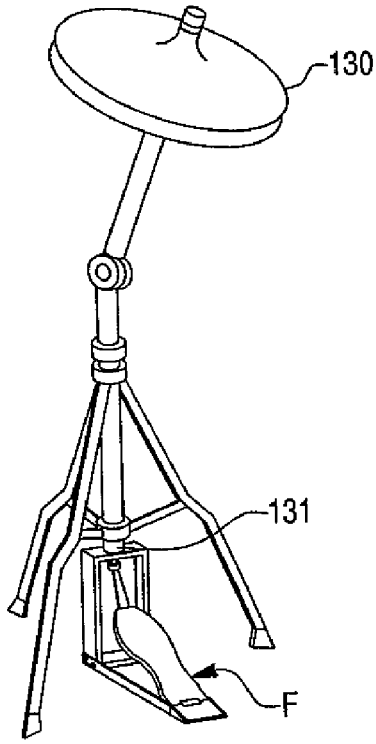
FIG. 2 is a schematic showing a conventional foot pedal as used with a high hat cymbal.
Figure 3:
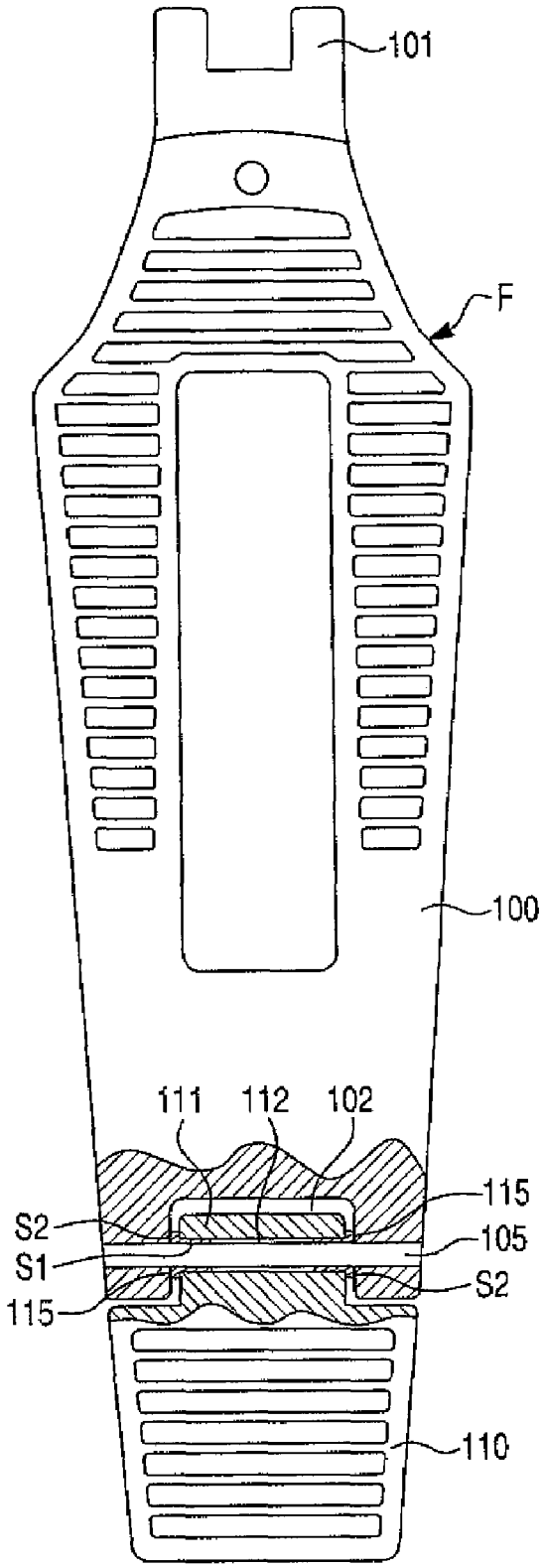
FIG. 3 illustrates a conventional footboard and heel plate.

In the preferred embodiment shown in FIGS. 4-8, the foot pedal assembly 1 includes a movable, elongated footboard 10 that operates the action part of a drum beater or the action rod for playing a musical instrument like a drum or a cymbal (for example as shown in FIGS. 1 and 2). The link or connection system 11 from the front portion of the footboard 10 to the action part is conventional, being connected to a driver, like a beater or cymbal support. As is known in the art, the link 11 may be a chain, a belt, a rigid linkage, or the like. The footboard 10 is also connected to a stationary heel section 20 at the rear portion of the plate 10. The heel section shown in FIG. 4 includes the main heel section 20 and further includes a movable heel section 18 as will be described in more detail below.

Figure 10:
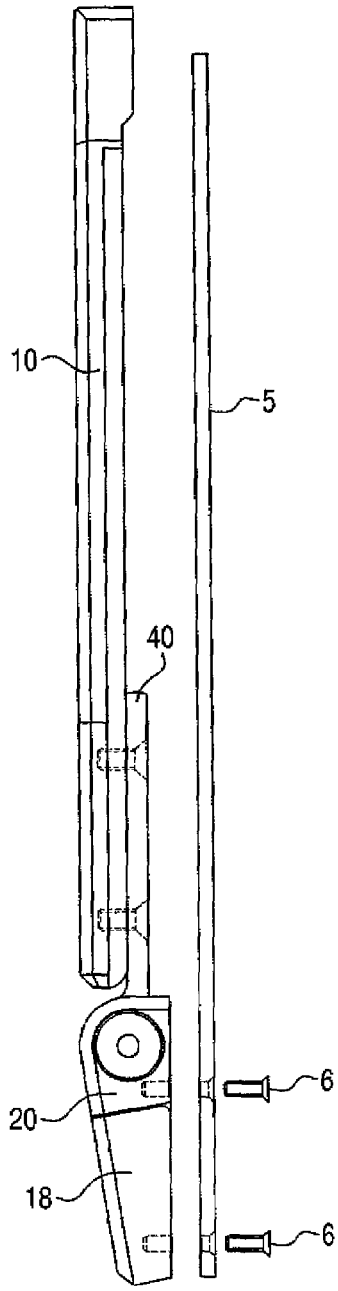
FIG. 10 is a side view of the footboard and heel plate assembly in the short footboard position.
Figure 12:
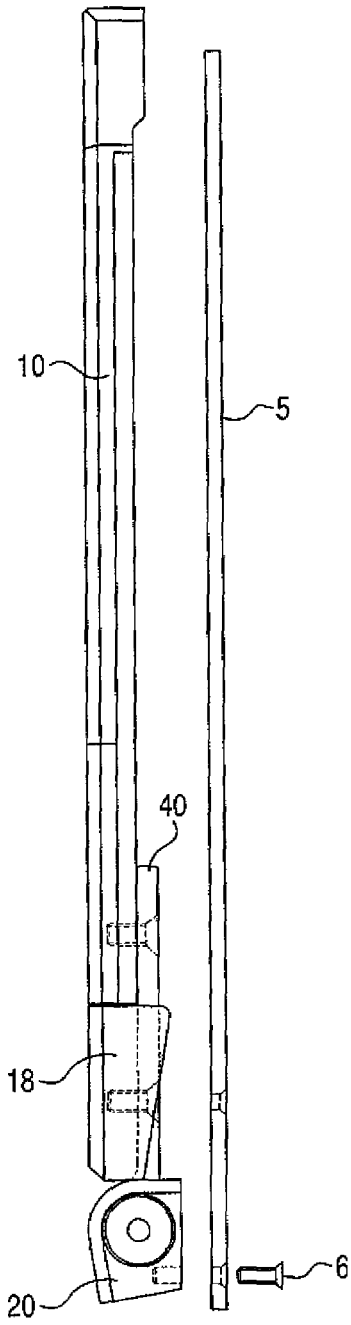
FIG. 12 is a side view of the footboard and heel plate assembly in the long footboard position.

As will be described in more detail below, the foot pedal assembly 1 further includes a base plate 5 shown in FIGS. 10 and 12, whereby the heel section is fixedly secured to the base plate 5 via fasteners 6. As is known by those of skill in the art, the base plate 5 may take many forms including a solid flat platform or a pair of bars forming a base that support the foot pedal assembly relative, for example, to a pair of upstanding support members that, in turn, hold a rotating shaft deposed between their upper portions to drive a drum beater. The foot pedal assembly may also be used in conjunction with a hi-hat system.

Figure 4:
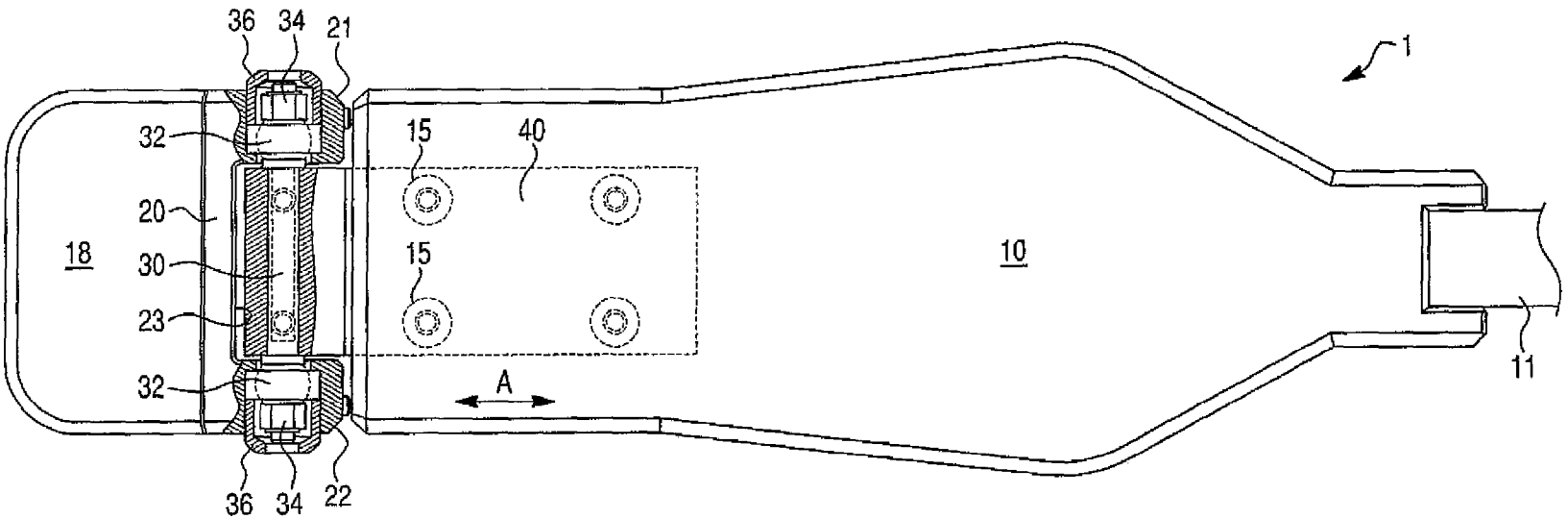
FIG. 4 illustrates the footboard and heel plate assembly according to the present invention.

In accordance with this invention, the movable footboard 10 and the stationary heel section 20 are rotatably connected by a hinge shaft 30 that passes through two flanges 21, 22 of the heel section 20 and a hinge plate 40 interconnected to the footboard 10 by countersunk bolts or screws 15. The hinge shaft 30 also passes through spherical bearings 32 and nuts 34 that are disposed respectively in the flanges 21, 22 located on both sides of the concave 23 in the heel plate 20, as seen in FIG. 4. In the preferred embodiment, hinge caps 36 may be disposed at the two lateral ends of the hinge shaft 30 to improve the durability of the hinge system and to improve the aesthetics of the overall assembly.

Figure 13:
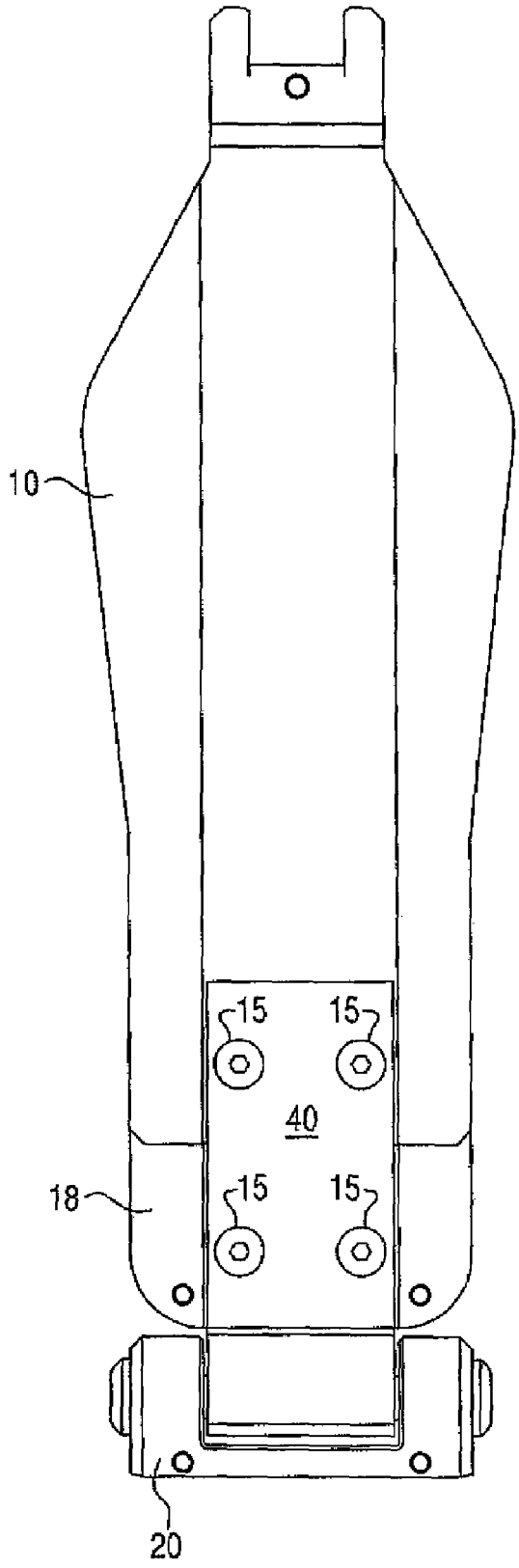
FIG. 13 is a bottom view of the footboard and heel plate assembly in the long footboard position.

As will be described with reference to FIGS. 9-13, the movable heel section 18 may be fixed to the base plate 5 in the short footboard position (FIG. 9) or may be repositioned and affixed to the hinge plate 40 in the long footboard position (FIG. 13).

As shown in FIG. 4, the axle 30 runs through the wall 22 at the lower part of the convex projections 21, 22 of the heel section 20 and is supported therein by the spherical bearings 32. It is important to note that the present invention utilizes spherical bearings 32 in order to improve the function of the pedal assembly. Spherical bearings 32 can compensate for a slightly misaligned axle 30 thus allowing the pedal to function normally. On a similar misaligned axle using conventional fixed bearings, the fixed bearing assembly will tend to bind and cause unwanted friction that can hinder the speed and responsiveness of the pedal or footboard.

In accordance with this invention, the hinge plate 40 is fixed to the footboard 10 via two countersunk bolts 15 in a secure but variable manner as will be described in more detail below. As a result of the construction of the footboard 10 and hinge plate 40, the footboard 10 is connected to the hinge system through the hinge plate 40. Thus, the footboard 10 may be attached to the hinge plate 40 in two locations by shifting the footboard in the direction of arrow 'A' (See FIG. 4, and FIGS. 9 to 13), which makes the footboard longer or shorter relative to the hinge system. The footboard is a lever and when the footboard is in a longer configuration it has more leverage and, thus, less force is needed to initiate the pedal action. As a result, the footboard feels lighter to the player. Further, the footboard can accommodate feet of different size. These features will be described in more detail below.

Figure 5:
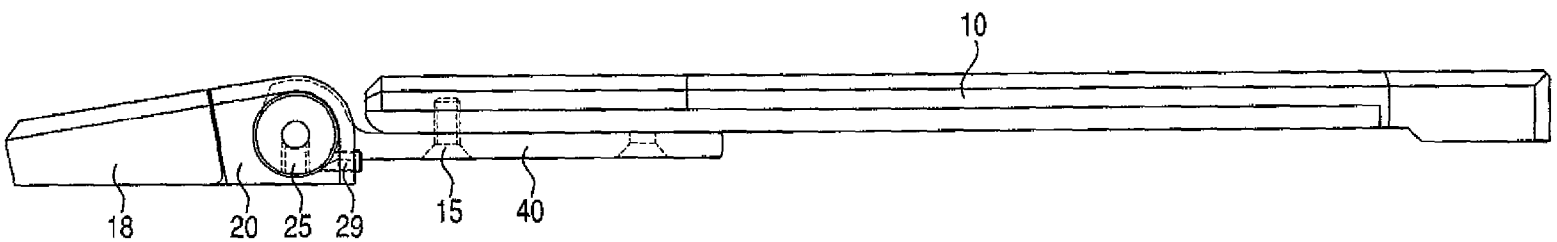
FIG. 5 illustrates a side view of the footboard and heel plate shown in FIG. 4.
Figure 6:
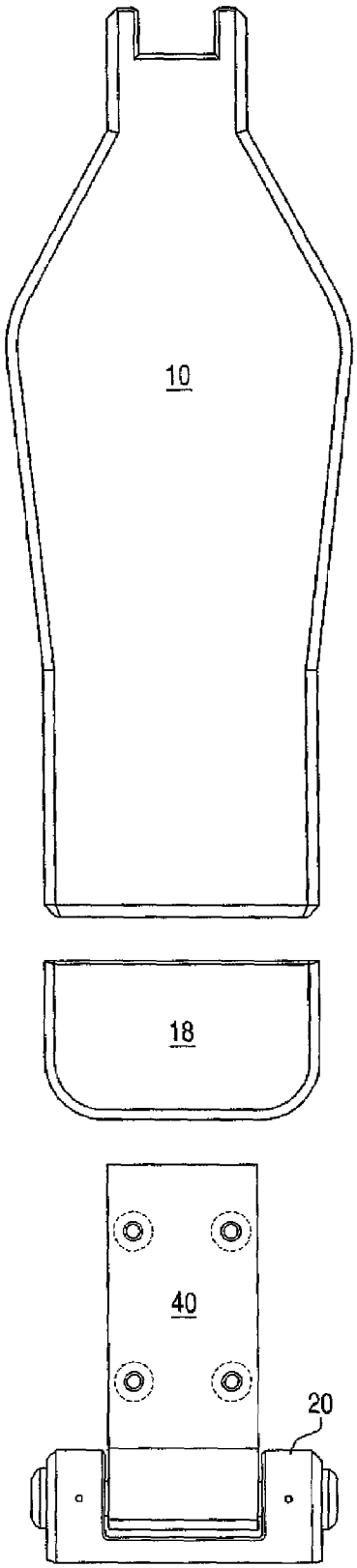
FIG. 6 is an exploded top view of the footboard and heel plate assembly shown in FIG. 4 with the heel plate in the long footboard position.
Figure 7:
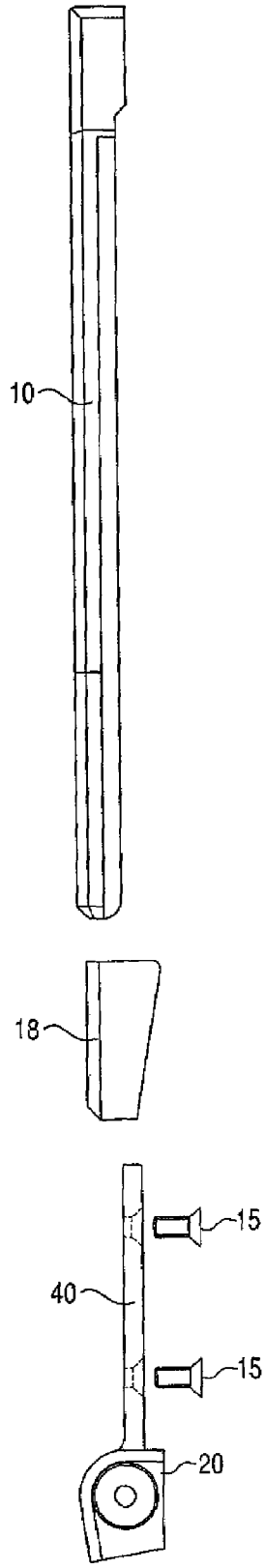
FIG. 7 is an exploded side view of the footboard and heel plate assembly of FIG. 5 with the heel plate in the long footboard position.
Figure 8:
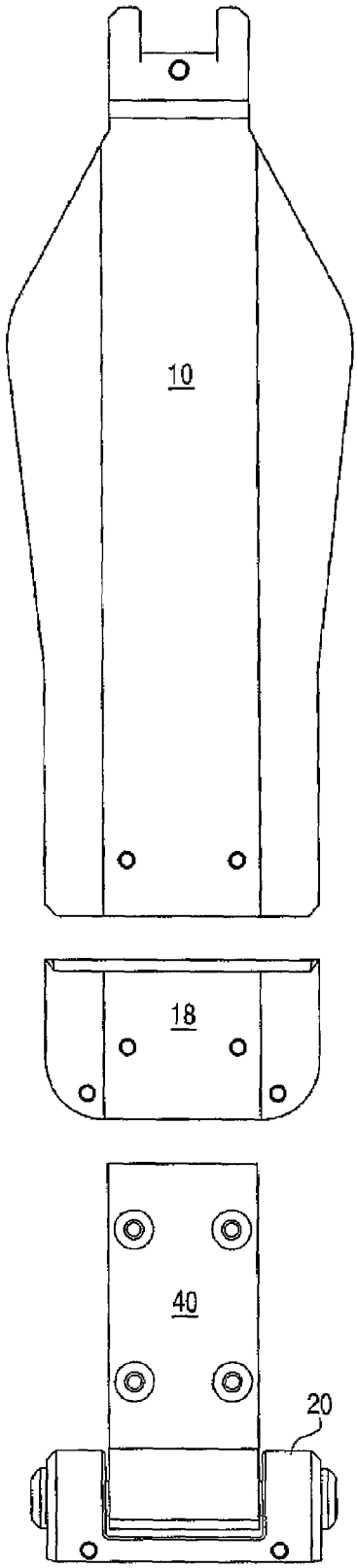
FIG. 8 is an exploded bottom view of the footboard and heel plate assembly of FIG. 5 with the heel plate in the long footboard position.
Figure 14:
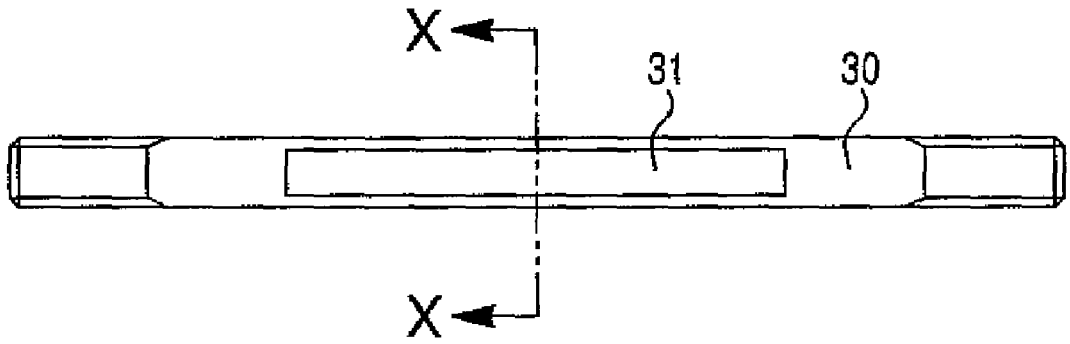
FIG. 14 is a top view of the hinge shaft.
Figure 15:
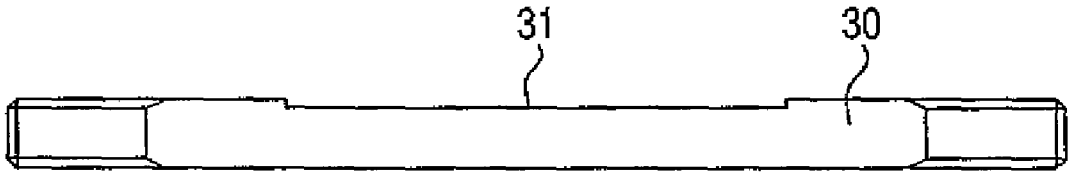
FIG. 15 is a side view of the axle shaft of FIG. 14.
Figure 16:
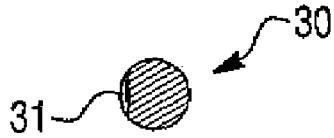
FIG. 16 is a cross sectional view of the axle shaft of FIG. 14 as taken along section line X-X.

In the preferred embodiment, the hinge shaft 30 is fixed against rotation relative to the heel section 20 by a fixing member such as set screws or Allen screws 25, preferably a screw 25 that extends into the lower face of the heel section 20 as shown in FIGS. 4 and 5. The screws 25 engage a flat surface of the hinge shaft 30 which is formed with a d-shaped central area (see surface 31 in FIGS. 14-16). As illustrated, the axle 30 has the flattened central region 31 engaged by the set screws 25 to hold the hinge shaft 30 against rotation. To hold the axle 30 to the heel plate 20, threads are disposed on the peripheral ends of the axle 30 to matingly receive the nuts 34.

It is also noted that set screws or Allen screws 29 may be used to further lock and hold the end caps 36 in place even when the pedal assembly 1 is subjected to the rigors and vibration of ordinary use. Additionally, the end caps 36 may be used to compensate for wear if the footboard develops play or gets loose from normal wear and tear in the hinge elements. Adjustment is accomplished by loosening the Allen screws 29 and pushing the end caps 36 toward each other until the desired effect is achieved whereby the Allen screws 29 may be tightened to again lock and hold the end caps 36 in place.

The invention also contemplates at least one oil port for lubricating the spherical bearings 32.

Figure 9:
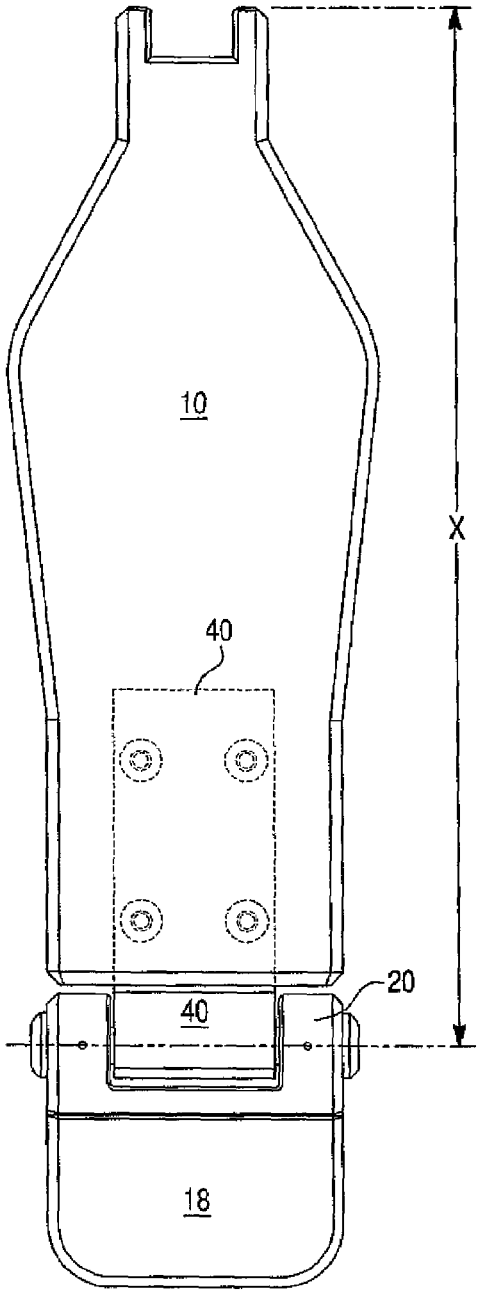
FIG. 9 is a top view of the footboard and heel plate assembly in the short footboard position.
Figure 11:
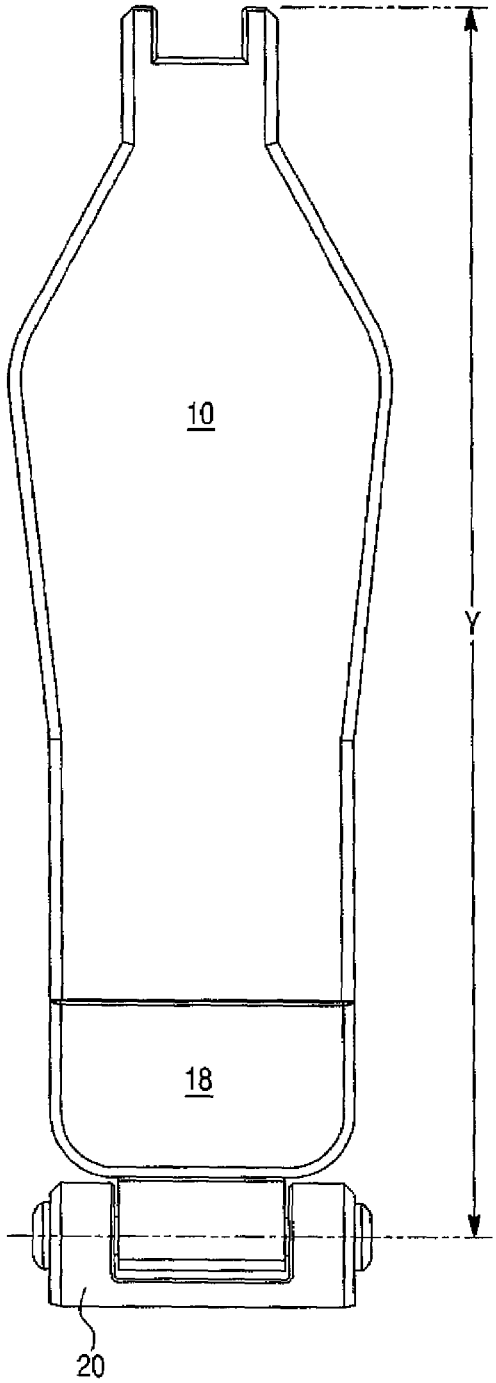
FIG. 11 is a top view of the footboard and heel plate assembly in the long footboard position.

As previously mentioned, the foot pedal assembly 1 is provided with a versatile design that permits the length of the footboard to be modified to adjust the feel of the pedal and to accommodate different foot sizes. With reference to FIGS. 9 to 13, the length-adjustment capability of this invention will now be described. In FIGS. 9 and 10, the pedal assembly is shown in the short footboard position, whereby the footboard 10 is fixed to the hinge plate 40 by the two countersunk bolts 15 and the movable heel section 18 is affixed directly to the base plate 5 by bolts 6. With this arrangement, the length of footboard from the hinge shaft 30 to the end of the footboard where the connection system 11 is affixed is shown by the length 'X' labeled on FIG. 9. In FIGS. 11 and 13, the pedal assembly is shown in the long footboard position, whereby the footboard 10 is fixed to the hinge plate 40 by two countersunk bolts 15 (see FIG. 13) and the movable heel section 18 is affixed directly to the hinge plate 40 by the other two countersunk bolts 15 (see FIG. 13). With this arrangement, the length of footboard from the hinge shaft 30 to the end of the footboard where the connection system 11 is affixed is shown by the length 'Y' labeled on FIG. 11. In both the short and long footboard positions, the stationary heel section 20 is affixed directly to the base plate 5, the stationary heel section is affixed to different positions on the base plate 5 as shown in FIGS. 10 and 12.

Figure 17:
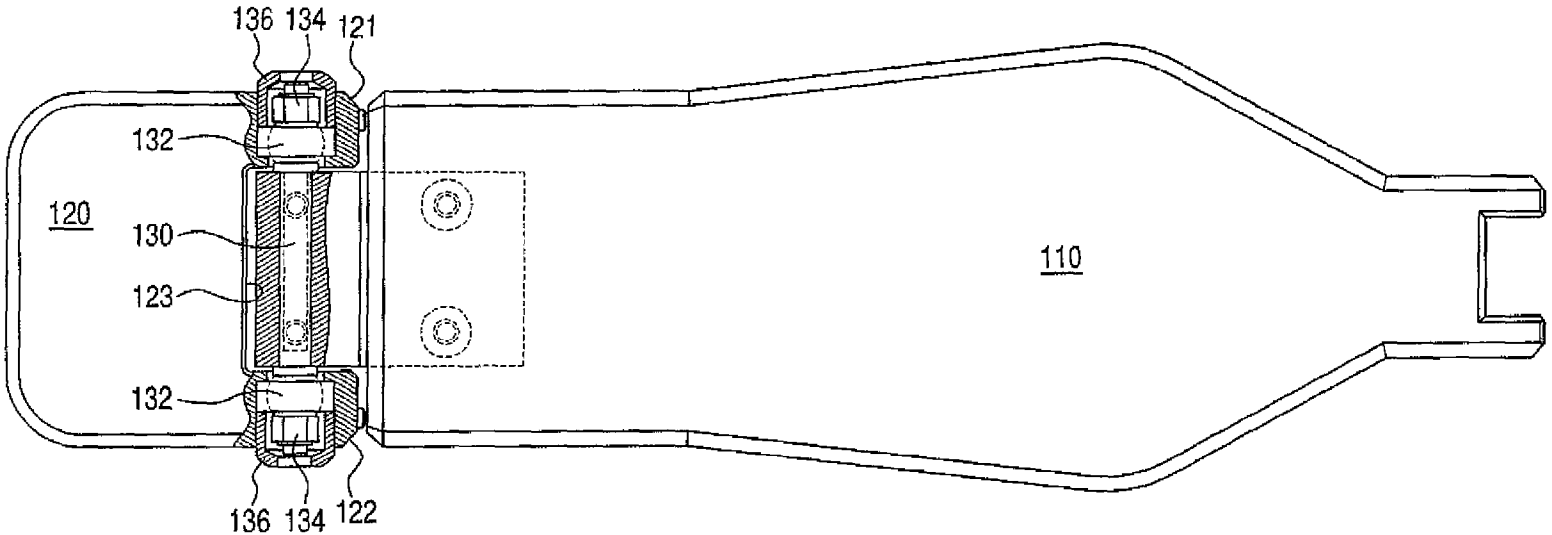
FIG. 17 illustrates the footboard and heel plate assembly according to a second embodiment of the present invention.
Figure 18:
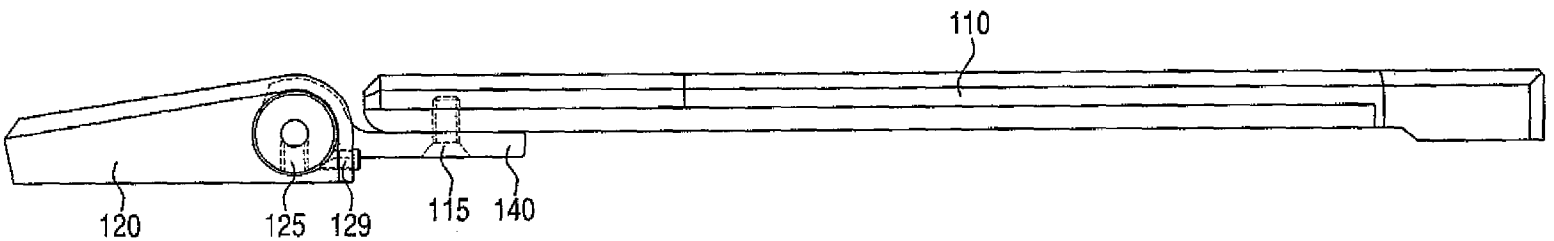
FIG. 18 illustrates a side view of the footboard and heel plate shown in FIG. 17.

In accordance with an important aspect of this invention, the heel section 18 of FIGS. 4-13 may be eliminated. As shown in FIGS. 17 and 18, the stationary heel section 120 may rotatably connected to the footboard 110 by a hinge shaft 130 that passes through two flanges 121, 122 of the heel section 120 and a hinge plate 140 interconnected to the footboard 110 by a pair of countersunk bolts or screws 115. The hinge shaft 130 also passes through spherical bearings 132 and nuts 134 that are disposed respectively in the flanges 121, 122 located on both sides of the concave 123 in the heel plate 120, as seen in FIG. 17. Hinge caps 136 similarly may be disposed at the two lateral ends of the hinge shaft 130 to improve the durability of the hinge system and to improve the aesthetics of the overall assembly. In this alternate embodiment, the footboard 110 is not adjustably mounted with respect to the hinge shaft 130; instead, the footboard 110 is assembled to the hinge system at a fixed length. This alternate embodiment focuses instead on the unique provision of spherical bearings 132. As previously mentioned, spherical bearings 132 compensate for a slightly misaligned hinge shaft 130 thus allowing the pedal to function normally. On a similar misaligned hinge shaft using conventional fixed bearings, the fixed bearing assembly will tend to bind and cause unwanted friction that can hinder the speed and responsiveness of the pedal or footboard.

As with the first embodiment, the hinge shaft 130 may be fixed against rotation relative to the stationary heel section 120 by a fixing member such as set screws or Allen screws 125. Likewise, set screws or Allen screws 129 may be used to further lock and hold the end caps 136 in place even when the pedal assembly is subjected to the rigors and vibration of ordinary use. Additionally, the end caps 136 may be used to compensate for wear if the footboard develops play or gets loose from normal wear and tear in the hinge elements. Adjustment is accomplished by loosening the Allen screws 129 and pushing the end caps 136 toward each other until the desired effect is achieved whereby the Allen screws 129 may be tightened to again lock and hold the end caps 136 in place.

As previously mentioned, the invention also contemplates at least one oil port for lubricating the spherical bearings 132.

Although the present invention has been described in relation to particular embodiments thereof, many other variations and modifications and other uses will become apparent to those skilled in the art. It is preferred, therefore, that the present invention be limited not by the specific disclosure herein, but only by the appended claims. For example, the hinge plate may be adjustable affixed to the front portion of the heel plate and the footboard may be provided with the flanges 21, 22 illustrated on the stationary heel section to essentially reverse or rearrange the structural arrangement that permit adjustment of the length of the footboard.

The invention claimed is:

1. A foot pedal apparatus for operating a musical instrument, the foot pedal apparatus comprising:

an elongated footboard with front and rear portions and a connection system at said front portion thereof for connection to the musical instrument;

a stationary heel section with a front portion;

an adjustable hinge plate fixed to one of said rear portion of said footboard and said front portion of said heel plate; and a hinge assembly coupling said footboard rear portion to said heel plate front portion and enabling the footboard to pivot relative to the heel plate, said hinge assembly comprising a hinge shaft extending through said hinge plate and at least one extension of one of said rear portion of said footboard and said front portion of said heel plate, wherein said hinge plate may be fixed at different positions relative to said footboard and said heel plate to adjust a length of said footboard relative to said axle.

2. The foot pedal assembly according to claim 1, wherein further comprising removal heel plate member selectively affixed to said heel section at a plurality of discrete locations.

3. The foot pedal assembly according to claim 2, wherein one of said discrete locations is between said heel section and said footboard.

4. The foot pedal assembly according to claim 3, wherein another of said discrete locations is opposite said footboard with respect to said hinge shaft.

5. The foot pedal assembly according to claim 1, wherein said hinge plate is securely affixed to said footboard.

6. The foot pedal assembly according to claim 5, wherein said hinge plate may be affixed to said footboard at two discrete positions relative to said footboard to make the footboard longer relative to said axle.

7. The foot pedal assembly according to claim 1, further comprising at least one spherical bearing disposed on said axle to compensate for misalignment between the footboard and the heel plate.

8. The foot pedal assembly according to claim 1, further comprising at least one set screw locking said hinge shaft against rotation with respect to said adjustable hinge plate.

9. The foot pedal assembly according to claim 7, further comprising at least one nut threaded onto said hinge shaft retained said bearing within said hinge assembly.

10. The foot pedal assembly according to claim 9, further comprising at least one end cap to further adjust and retained said bearing within said hinge assembly.

11. A foot pedal apparatus for operating a musical instrument, the foot pedal apparatus comprising:

an elongated footboard with front and rear portions and a connection system at said front portion thereof for connection to the musical instrument, said footboard further comprising an extension portion at said rear portion;

a stationary heel section with a front portion;

a hinge assembly coupling said footboard rear portion to said heel plate front portion and enabling the footboard to pivot relative to the heel plate, said hinge assembly comprising a hinge shaft extending through said extension portions on said rear portion of said footboard and said front portion of said heel plate; and at least one spherical bearing disposed on said hinge shaft to compensate for misalignment between the footboard and the heel plate.

12. The foot pedal assembly according to claim 11, further comprising at least one set screw locking said hinge shaft against rotation with respect to said adjustable hinge plate.

13. The foot pedal assembly according to claim 12, further comprising at least one nut threaded onto said hinge shaft retained said bearing within said hinge assembly.

14. The foot pedal assembly according to claim 12, further comprising at least one end cap to further adjust and retained said bearing within said hinge assembly.

15. The foot pedal assembly according to claim 11, further comprising an adjustable hinge plate fixed to one of said rear portion of said footboard and said front portion of said heel plate, wherein said hinge plate may be fixed at different positions relative to said footboard and said heel plate to adjust a length of said footboard relative to said axle.

16. The foot pedal assembly according to claim 15, wherein further comprising removable heel plate member selectively affixed to said heel section at a plurality of discrete locations, wherein one of said discrete locations is between said heel section and said footboard and another of said discrete locations is opposite said footboard with respect to said hinge shaft.

* * * * *